US005953949A

United States Patent [19]

Behr et al.

[11] Patent Number: 5,953,949

[45] Date of Patent: Sep. 21, 1999

[54] METHOD AND APPARATUS FOR PRODUCING A METAL STRIP HAVING AREAS OF DIFFERENT THICKNESS OVER ITS WIDTH

[75] Inventors: Friedrich Behr, Krefeld; Klaus Blümel, Dinslaken; Thomas Flehmig, Ratingen, all of Germany

[73] Assignee: Thyssen Krupp Stahl AG, Duisburg, Germany

[21] Appl. No.: 09/160,872

[22] Filed: Sep. 25, 1998

[30] Foreign Application Priority Data

Sep. 30, 1997 [DE] Germany ..... 197 43 093

[51] Int. Cl.[6] ..... B21B 13/10; B21B 1/00

[52] U.S. Cl. ..... 72/224; 72/366.2

[58] Field of Search ..... 72/235, 224, 252.5, 72/365.2, 366.2, 240, 250, 199, 112, 124

[56] References Cited

U.S. PATENT DOCUMENTS 3,813,912 6/1974 Matsufuji et al. ..... 72/224

4,685,319 8/1987 Aoyagi et al. ..... 72/366.2

*Primary Examiner*—Rodney Butler

*Attorney, Agent, or Firm*—Proskauer Rose LLP

[57] ABSTRACT

The invention relates to the production of a metal strip having formed-in thinner areas. To this end the strip B is drawn through a drawing nip 1, 2 formed by the end face of a working roll 3 adjusted at an angle and a support roll 4, which can take the form of a working roll. When drawing takes place through the working nip 1, 2, a rolling force and simultaneously a tensile force transversely of the pulling direction are so exerted on the strip B by the two rolls 3, 4 that the displaced material flows practically exclusively transversely of the pulling direction in the areas to be thinned down.

17 Claims, 6 Drawing Sheets

METHOD AND APPARATUS FOR PRODUCING A METAL STRIP HAVING AREAS OF DIFFERENT THICKNESS OVER ITS WIDTH

BACKGROUND OF THE INVENTION

The invention relates to a method of producing a metal strip having areas of different thickness over its width and also to an apparatus for the performance of the method.

In order to make an economic use of material and dimension structural members in dependence on loading, for a fairly long time structural members have been used which have a differential thickness over their surface and/or length (Shaping Techniques, 7th Aachen Steel Conference, 26–27 March 1992 "4.2 Rolling of longitudinal sections optimised for loading" by B. Hachman, R. Kopp, Aachen). The initial products of such structural members are known as "tailored blanks". In practice there are two basically different methods of producing such tailored blanks.

In a first prior art method the thickness of a strip is reduced in portions in a roll stand nip which can be moved into position. The blanks for the required structural members can then be cut out of such a strip of differential thickness. The advantages of such a procedure lie in the fact that the transitions from the minimum to the maximum strip thickness are continuous. However, it is a disadvantage that the transitions are very long, since the roll nip cannot be provided very quickly. Another disadvantage is that very considerable forces are required for bringing up the roll nip. A roll stand must be particularly designed for this purpose, for example, it must have a special compensating device for the expansions of the roll stand under these strong forces. Moreover, in that method the otherwise customary roll speed of several hundreds of meters cannot be used. Such a method is therefore unsuitable for the production of tailored blanks.

It is also known to produce a metal strip having differential thickness areas over its width by rolling into the strip by means of a pair of rolls a strip of lesser thickness extending in the longitudinal direction of the strip, one roll having in the axial direction at least one portion of larger diameter than in the remaining zone (DE 33 43 709 A1). It is not known that such a method has been adopted in practice for the production of tailored blanks.

In contrast, another method of producing tailored blanks is very widespread. The method starts from two sheets of different thickness, which are welded to one another via a butt joint. The advantages of such a method reside in the low cost of apparatus for welding together, so that the method is also suitable for small runs. The disadvantages are that there are no gentle transitions from the thinner to the thicker material, so that the saving in weight is not optimum, having regard to the loading occurring. There is also the aspect that the sudden change in thickness also produces a sudden increase in stress from the thicker to the thinner material. Lastly, due to the weld which must be produced, the production speed of such tailored blanks is low.

Finally, a shaping process is known under the name of "full section draw forming" (Journal "DRAHT" (WIRE) 18 (1967) No. 1, pages 33 to 38), wherein for the production of a strip a solid body is drawn through a nip formed by two freely rotatable or driven rolls. There is no provision for the production of strips having differential thickness areas over their width.

Starting from this point, it is an object of the invention to provide a method and an apparatus for the production of a metal strip with areas of different thickness over its width and a gentle transition, thus permitting low-cost production at a comparatively high manufacturing speed.

SUMMARY OF THE INVENTION

This problem is solved in the method according to the invention by the features that at least one area of lesser thickness extending in the longitudinal direction of the strip is formed in a strip of constant thickness over its width by the strip being drawn through at least one drawing nip formed by an end face of a working roll and a support roll, the axis of rotation of the working roll being so adjusted at an inclination to the plane of the strip that when the strip is drawn through, the end face of the working roll exerts on the strip a force transversely of the longitudinal direction of the strip. The apparatus for the performance of the method according to the invention is characterised by guiding and pulling means for the strip and at least one drawing nip formed by the end face of a working roll and a support roll, the axis of rotation of the working roll being so adjusted at an inclination to the plane of the strip that when the strip is drawn through, the end face of the working roll exerts on the strip a force transversely of the longitudinal direction of the strip.

According to the invention, therefore, zones of lesser thickness than the initial strip thickness and extending in the longitudinal direction of the strip are formed therein as the strip passes through. The result is relatively high productivity. Moreover, the transitions between the thicker and thinner areas are gentle. The width of the thinner areas can be influenced via the diameter of the working roll and its adjustment. The same thing also applies to the transitional zones. The direction of flow of the material to be displaced is influenced, since each working roll acts on the material transversely of the direction of the strip in the thinned area. Unlike the forming of a groove in a strip using a roll of having a cylindrical generated surface, therefore, the material is not impermissibly heavily loaded, with the risk of strip tearing and waviness.

To avoid having to intercept forces acting on the strip by outer guiding means which engage therewith during the performance of the method according to one feature of the invention a further area parallel with the area of lesser thickness is simultaneously formed in by the strip being drawn through a second drawing nip corresponding laterally inverted to the first drawing nip, the forces thus exerted on the strip compensating one another transversely of the longitudinal direction of the strip. In dependence on subsequent use, these areas can be completely separated from one another or in practice abut one another, so that a start can be made from a single area. Any excess height occurring in the centre between the two areas can be evened out by after-rolling.

To thin the metal strip in areas, a working roll need be provided only on one side, while a cylindrical support roll acts on the other side. Advantageously according to one feature of the invention the support roll used is a further working roll, so that a shaping force is exerted on the strip from both sides of the strip by identical working rolls adjusted at an inclination to the plane of the strip.

As already mentioned, the dimensioning of the thinned area can be influenced by the dimensioning of the working roll. Influence can also be exerted by the axis of rotation of the working roll being tilted in different directions. Preferably the axes of the working rolls are tilted both around an axis parallel with the longitudinal axis of the strip and also around an axis extending parallel with the plane of the strip and perpendicularly of the strip longitudinal axis. This possibility of adjustment results in different areas of engagement with different directions of force. If with adjoining working rolls their axes of rotation are tilted in the direction of one another and in the pulling direction of the strip, tensile forces occur between the two working rolls. Tensile forces also occur between the two working rolls if their axes of rotation are tilted away from one another and against the pulling direction of the strip. In contrast, pressure forces occur between the working rolls if the axes of the working rolls are tilted away from one another and in the pulling direction, or towards one another and against the pulling direction.

The displacement of material in those zones which are to be thinned transversely of the pulling direction of the strip results in a wave being formed at the strip edges with the strip held flat between the working rolls. To prevent this, according to another feature of the invention a bead compensating the widening of the strip is formed in the free area between the drawing nips. The bead need not be permanent, but can subsequently be flattened again.

The problem is also solved by an apparatus having the features of claim 5.

With the apparatus according to the invention in order to be able to intercept the reaction forces acting on the working rolls during the forming in of the thinner areas, according to one feature of the invention the generated surfaces of the working rolls bear against one another directly or indirectly via running rings. When cylindrical or conical generated surfaces are directly borne, the working rolls can roll down one another free from slip. To make the rolling down as slip-free as possible with indirect bearing against the rings, according to one feature of the invention a number of running rings disposed concentrically one above the other and rotatable independently of one another support the working rolls at their conical generated surfaces.

As already stated hereinbefore, the geometry of the working roll is inter alia decisive for the profile of the formed-in areas. According to a preferred feature of the invention each working roll has on its end face associated with the drawing nip an engagement surface taking the form of a conical annular surface. More particularly the angle of the formed-in area can be influenced if the engagement surface is such a conical annular surface.

The apparatus can operate with working rolls which are driven, or working rolls which are freely rotatable and are in that case entrained by the strip.

Preferably the method is used on hot steel strip having a temperature of >600° C. It is also regarded as advantageous if the method is applied to recrystallize annealed cold steel strip which is locally heated to above 600° C. in the shaping zone after being shaped.

Embodiments of the invention will now be explained in greater detail with reference to the drawings in which like reference numerals designate the same elements.

DETAILED DESCRIPTION OF THE PREFERRED EMBODIMENT

Figure 4:
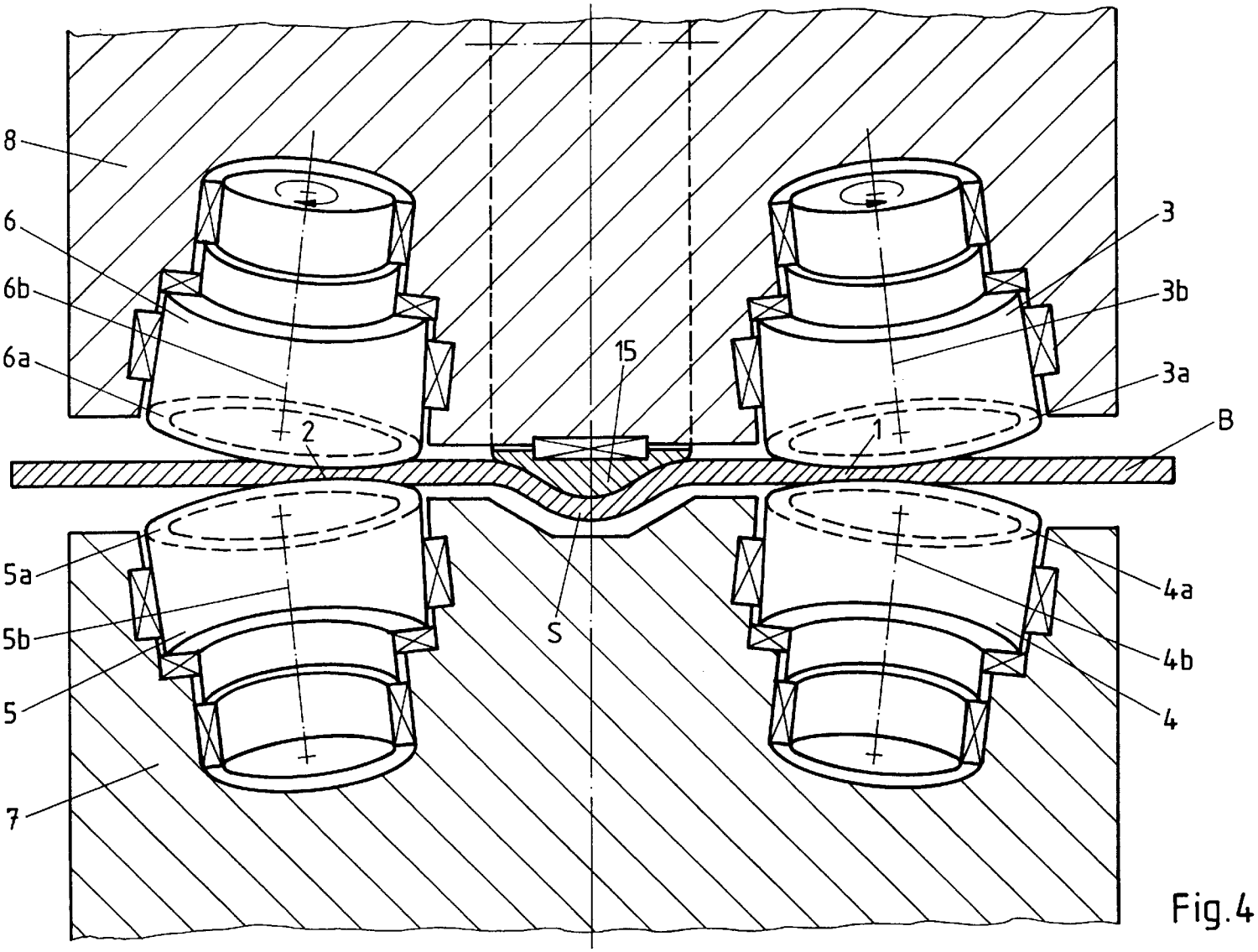
FIG. 4 is a cross-section of a first embodiment of an apparatus for the production of a strip with two thinned areas.
Figure 5:
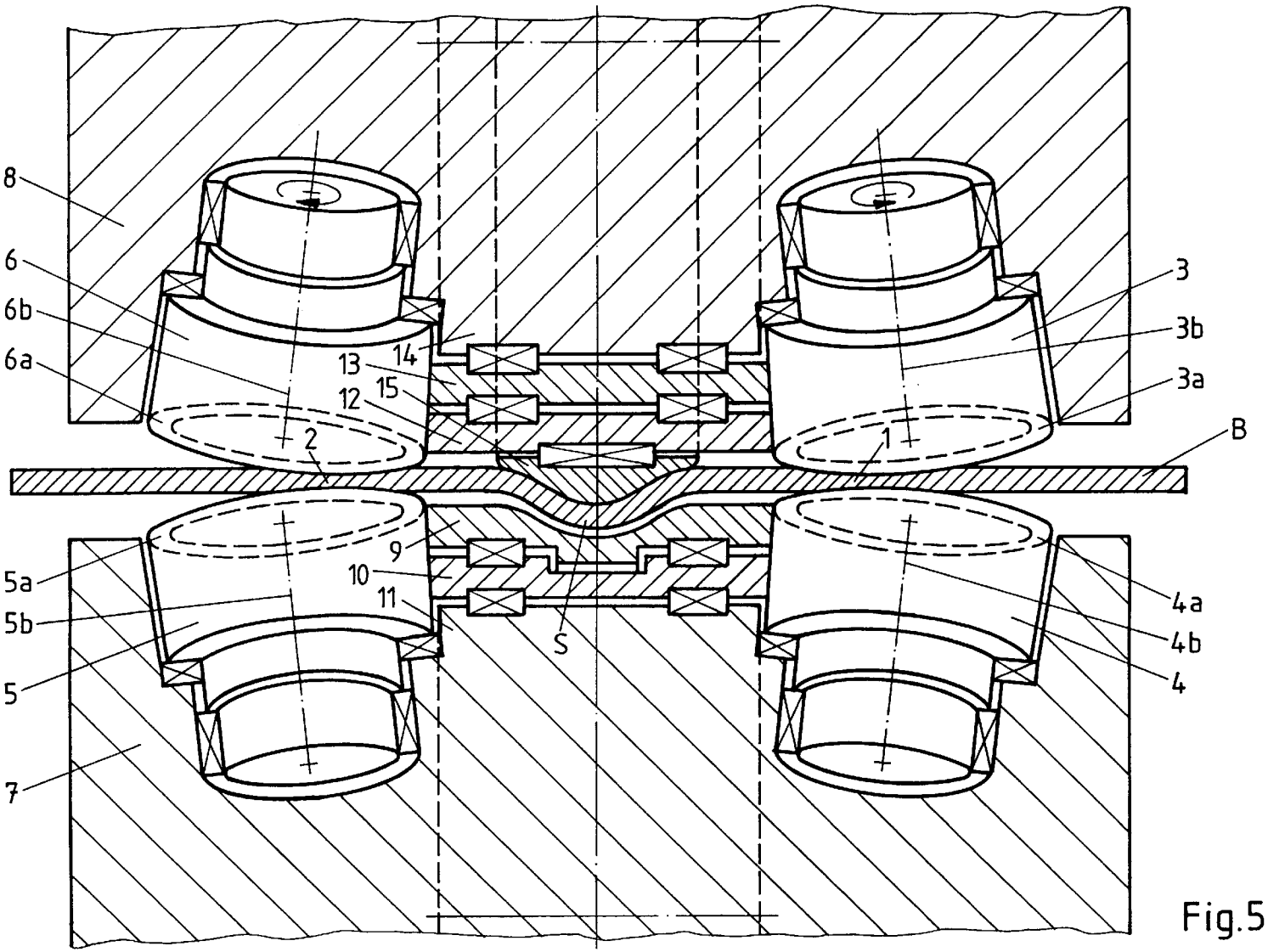
FIG. 5 is a cross-section of a second embodiment of the apparatus for the production of a metal strip with two thinned-out areas.

The devices as shown in FIGS. 4 and 5 are intended for the production of a metal strip having two spaced-out thinned-down areas. To this end each device has two pairs of working rolls 3, 4, 5, 6 forming a drawing nip 1, 2 therebetween. The area of engagement of the working rolls 3, 4, 5, 6 is disposed on their end face and is formed by conical annular surfaces 3*a*, 4*a*, 5*a*, 6*a*. The working rolls 3, 4, 5, 6 are made up of individual portions, more particularly frustoconical portions, whose diameter decreases in the axial direction. The working rolls 3, 4, 5, 6 are mounted freely rotatable via radial and axial bearings in a frame 7, 8. While in the embodiment illustrated in FIG. 4 the working rolls are borne exclusively in the frame 7, 8, in the embodiment shown in FIG. 5 they also bear against co-rotating rings 9, 10, 12, 13, which are mounted freely rotatable on one another and each on a cylindrical bearing seat 11, 14 attached to the frame. A shaping roll 15 between the upper working rolls 3, 4 is mounted freely rotatably either in the frame (FIG. 4) or on the upper outer support ring 12.

Both embodiments share the feature that the axes of rotation 3*b*, 4*b*, 5*b*, 6*b* of the working rolls are tilted twice, namely on the one hand in the direction of one another and on the other hand in the pulling direction of the strip B.

Figure 1:
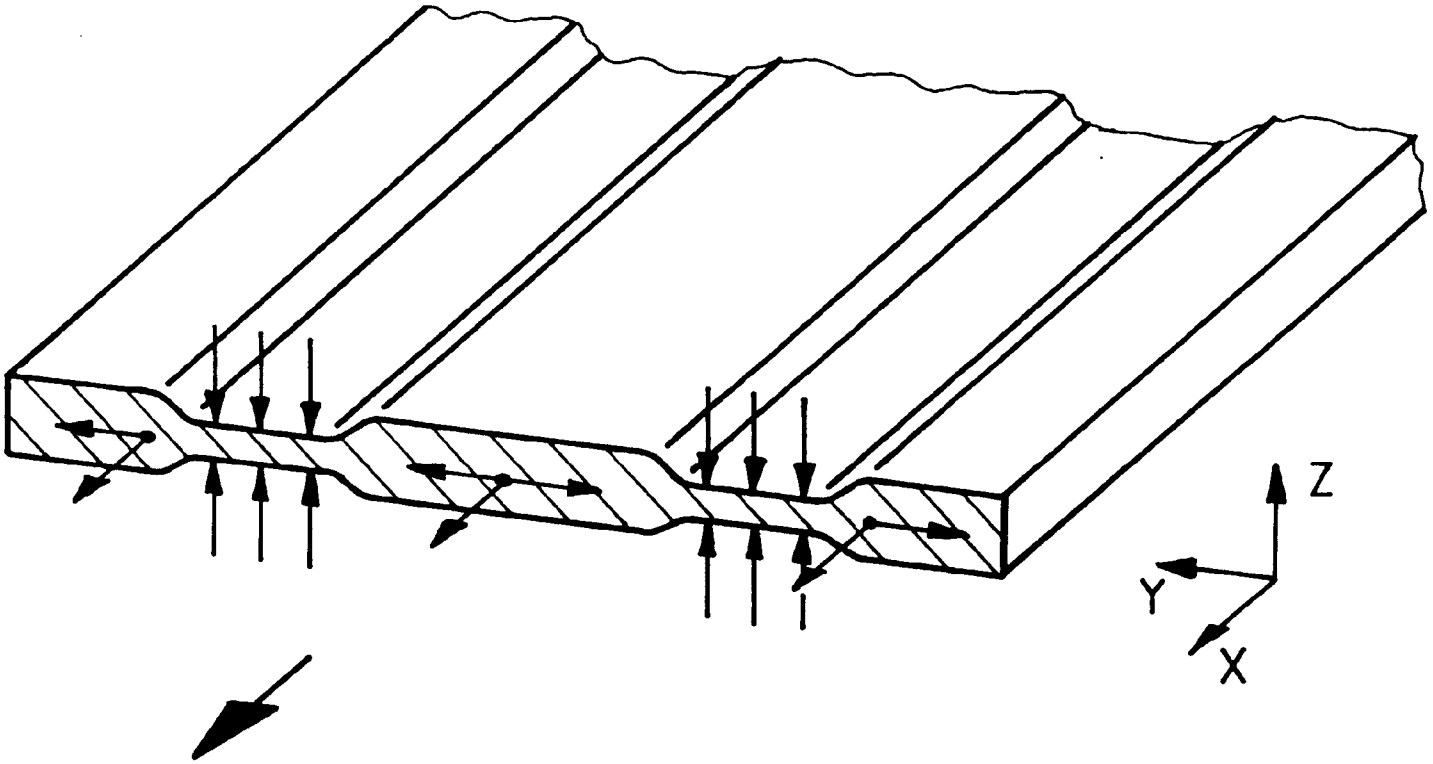
FIG. 1 is an isometric view and a section of a strip having two thinner areas.
Figure 6:
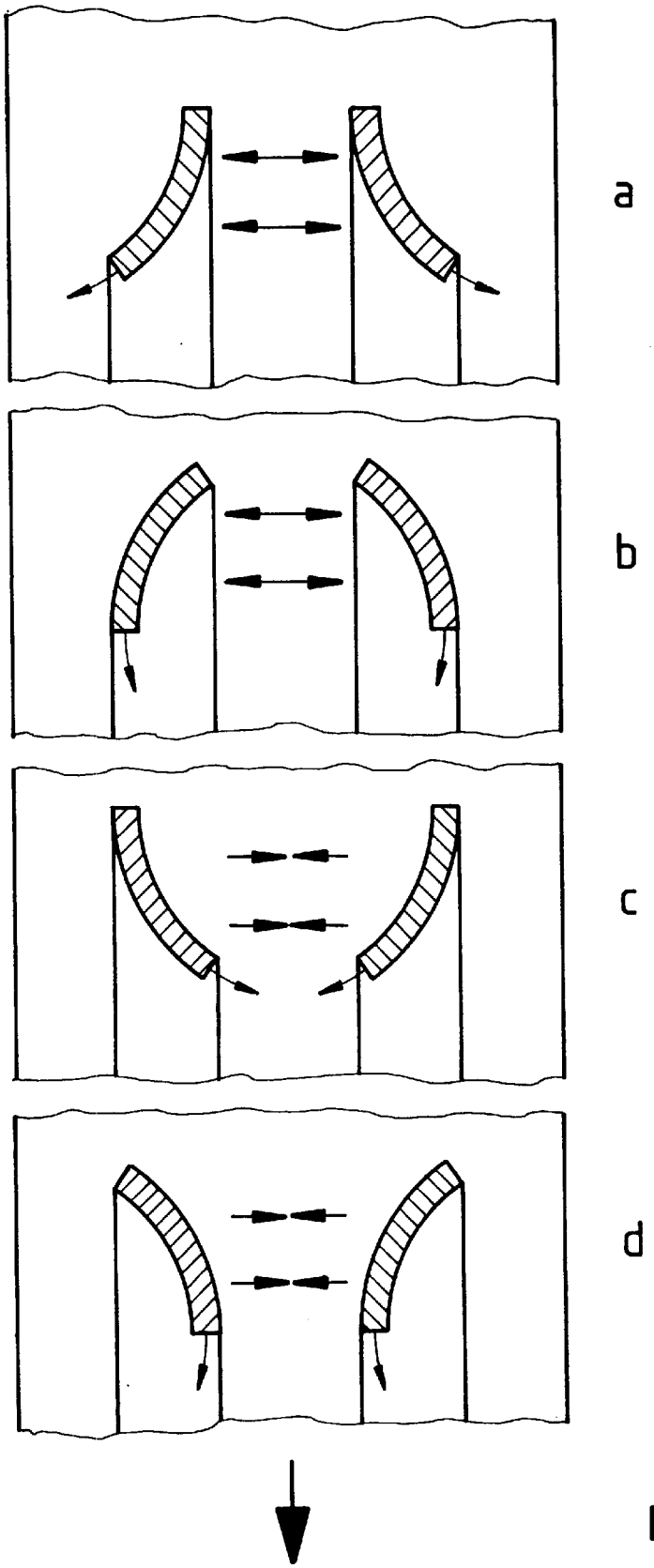
FIG. 6*a* is a schematic view depicting areas of engagement for an adjustment of the working rolls in which there is tensile stress between the areas to be thinned.
FIG. 6*b* is a schematic view depicting areas of engagement for another adjustment of the working rolls in which there is tensile stress between the areas to be thinned.
FIG. 6*c* is a schematic view depicting areas of engagement for an adjustment of the working rolls in which there is compressive stress between the areas to be thinned.
FIG. 6*d* is a schematic view depicting areas of engagement for another adjustment of the working rolls in which there is compressive stress between the areas to be thinned.

If a strip whose thickness is greater than the clear height of the drawing nip 1, 2 is drawn through the apparatus shown in FIGS. 4 or 5, the result is a strip as shown in FIG. 1. The working rolls 3, 4, 5, 6 exert via their end face conical rings 3*a*, 4*a*, 5*a*, 6*a* in the areas to be thinned out a rolling force w. The zones of engagement are shown in FIG. 6. With working rolls 3, 4, 5, 6 freely rotatably mounted, they are entrained during the passage of the strip and exert on the strip a pull transversely of the pulling direction, which results in the material flowing into the areas to be thinned practically exclusively transversely of the longitudinal axis of the strip. This effect of the flowing of the material, practically exclusively transversely of the pulling direction, can also be achieved with other adjustments of the working rolls, as shown in FIGS. 6*b*, *c* and *d*. The difference is merely that with the adjustment shown in FIGS. 6*a* and *b* there is tensile stress between the areas to be thinned, while with the adjustment shown in FIGS. 6*c* and *d* there is compressive stress between the areas to be thinned.

Since as the strip B is pulled through the drawing nip 1, 2 the strip as a whole is widened at the strip edges alongside the working rolls 3, 4, 5, a wave is formed which introduces stresses into the strip. In the embodiments illustrated in FIGS. 4 and 5 this effect is counteracted by the fact that the shaping roll 15 transiently forms a bead into the strip B. The bead compensates the widening otherwise affecting the strip edges.

Figure 2:
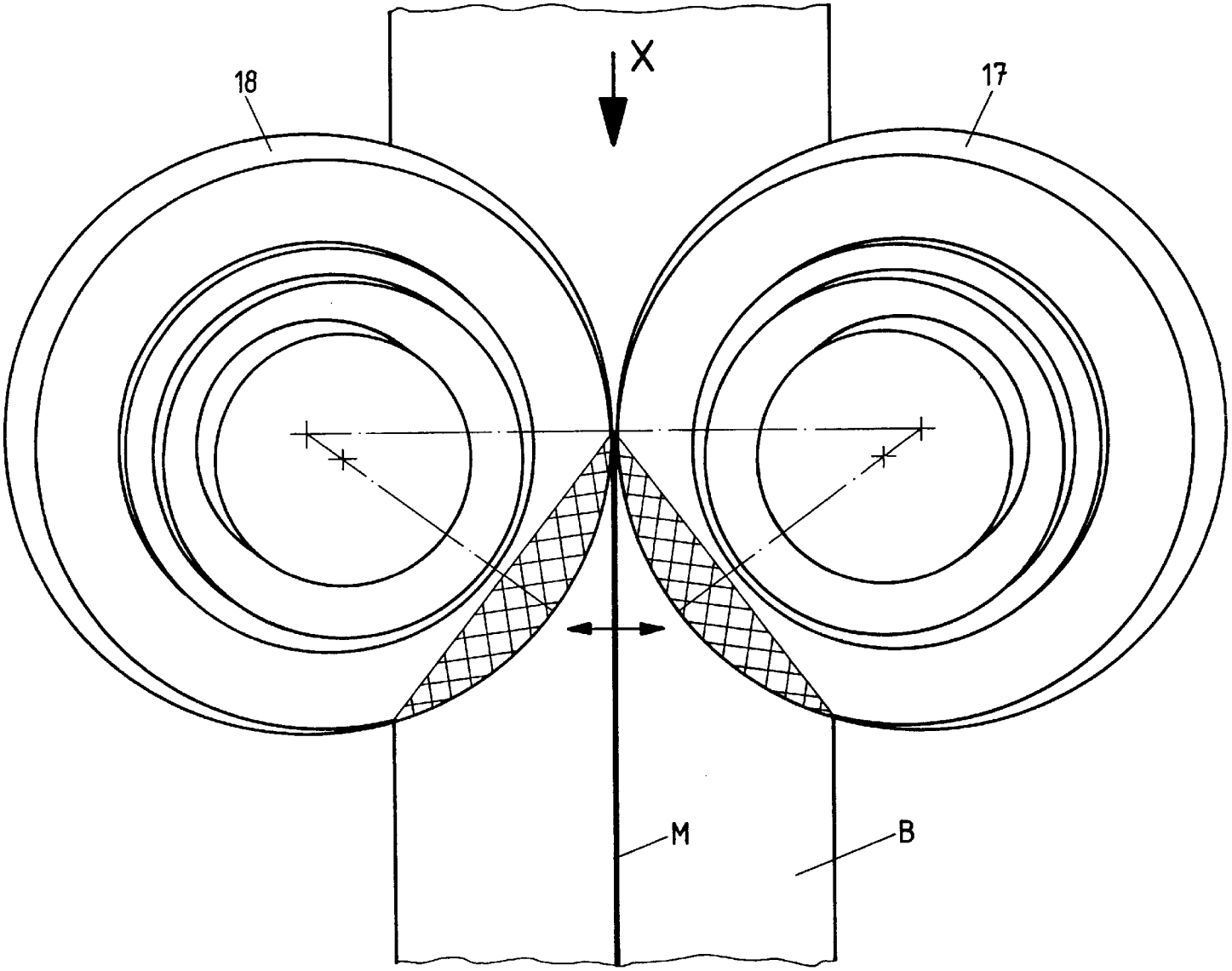
FIG. 2 is a plan view of a strip with two abutting thinned areas with two working rolls.
Figure 3:
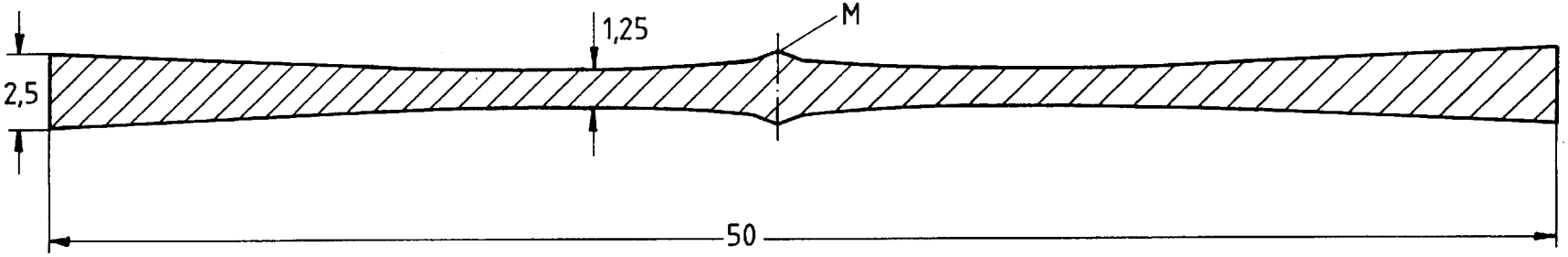
FIG. 3 is a cross-section of the strip shown in FIG. 2.

The embodiment shown in FIG. 2 differs from those shown in FIGS. 4 and 5 only by the feature that the working rolls 17, 18 are disposed immediately one beside the other. They can therefore roll down on one another and therefore bear against one another. The use of working rolls 17, 18 adjusted in this way produces a strip as shown in cross-section in FIG. 3. The slightly raised central zone M in this strip can be flattened in a subsequent rolling operation. If to compensate the widening a bead must be transiently formed in the strip B, this can advantageously be done by means of a sliding block (not shown) which is disposed between the working rolls 17, 18 in the free gusset area.

We claim:

1. A method of producing a metal strip having areas of different thickness over a width thereof, comprising:

providing at least one drawing nip formed by an end face of a working roll and a support roll;

drawing a strip of constant thickness over the width thereof through said at least one drawing nip; and adjusting an axis of rotation of the working roll at an inclination to a plane of the strip such that when the strip is drawn through said at least one drawing nip, the end face of the working roll exerts on the strip a force transverse to a longitudinal direction of the strip, thereby forming at least one area of lesser thickness extending in the longitudinal direction of the strip.

2. A method according to claim 1, wherein:

said at least one drawing nip includes a first drawing nip and a second drawing nip, said second drawing nip correspondingly laterally inverted to the first drawing nip, forces thus exerted on the strip by each of said first and second drawing nips compensating one another in a direction transverse to the longitudinal direction of the strip, whereby a further area parallel with the area of lesser thickness is simultaneously formed in the strip.

3. A method according to claim 1, wherein the support roll is a further working roll, the method further including adjusting an axis of rotation of the further working roll at another inclination to the plane of the strip such that a shaping force is exerted on the strip from both sides of the strip by analogously configured working rolls disposed at inclinations to the plane of the strip.

4. A method according to claim 2, further comprising:

forming a bead compensating for a widening of said strip produced by the first and second drawing nips, said bead being formed in a region of the strip located between the first and second drawing nips.

5. An apparatus for producing a metal strip having areas of different thickness over a width thereof, comprising:

a mechanism for guiding and pulling the strip; and at least one drawing nip formed by an end face of a working roll and a support roll, an axis of rotation of the working roll being selectively oriented at an inclination to a plane of the strip such that when the strip is drawn through said at least one drawing nip, the end face of the working roll exerts on the strip a force transverse to a longitudinal direction of the strip whereby forming at least one area of lesser thickness extending in the longitudinal direction of the strip.

6. An apparatus according to claim 5, further comprising means for adjusting said inclination.

7. An apparatus according to claim 5, wherein the support roll is a further working roll selectively oriented at another inclination to the plane of the strip, such that each drawing nip is formed by two analogously configured working rolls disposed at inclinations to the plane of the strip.

8. An apparatus according to claim 7, wherein rotational axes of the working rolls are each tilted around an axis parallel with the longitudinal direction of the strip and also around an axis extending parallel with the plane of the strip and perpendicular to the strip longitudinal axis.

9. An apparatus according to claim 7, wherein an end face of each of the working rolls associated with the at least one drawing nip includes an engagement surface in the form of a conical annular surface.

10. An apparatus according to claim 8, further comprising:

running rings; and said working rolls including generated surfaces which bear against one another directly via the running rings.

11. An apparatus according to claim 8, further comprising:

running rings; and said working rolls including generated surfaces which bear against one another indirectly via the running rings.

12. An apparatus according to claim 10, further comprising:

a shaping roll for forming a bead in the strip, the shaping roll being disposed between the drawing nips on one side of the strip.

13. An apparatus according to claim 10, wherein the generated surfaces of the working rolls are conical.

14. An apparatus according to claim 13, wherein the running rings are disposed concentrically one above the other and rotatable independently of one another, the running rings supporting the working rolls at the conical generated surfaces thereof.

15. An apparatus according to claim 11, further comprising:

a shaping roll for forming a bead in the strip, the shaping roll being disposed between the drawing nips on one side of the strip.

16. An apparatus according to claim 11, wherein the generated surfaces of the working rolls are conical.

17. An apparatus according to claim 16, wherein the running rings are disposed concentrically one above the other and rotatable independently of one another, the running rings supporting the working rolls at the conical generated surfaces thereof.

* * * * *